US009112285B2

(12) United States Patent
Liu et al.

(10) Patent No.: US 9,112,285 B2
(45) Date of Patent: Aug. 18, 2015

(54) DUAL FREQUENCY ANTENNA

(75) Inventors: Peng Liu, Shenzhen (CN); Gee Siong Kok, Shenzhen (CN)

(73) Assignee: Hytera Communications Corp., Ltd., Shenzhen, Guangdong (CN)

( * ) Notice: Subject to any disclaimer, the term of this patent is extended or adjusted under 35 U.S.C. 154(b) by 179 days.

(21) Appl. No.: 13/809,550

(22) PCT Filed: Jul. 14, 2010

(86) PCT No.: PCT/CN2010/075159

§ 371 (c)(1),
(2), (4) Date: Jan. 10, 2013

(87) PCT Pub. No.: WO2012/006781

PCT Pub. Date: Jan. 19, 2012

(65) Prior Publication Data

US 2013/0113676 A1 May 9, 2013

(51) Int. Cl.

| | |
|---|---|
| ***H01Q 1/36*** | (2006.01) |
| ***H01Q 21/30*** | (2006.01) |
| ***H01Q 11/08*** | (2006.01) |
| ***H01Q 5/357*** | (2015.01) |
| ***H01Q 5/378*** | (2015.01) |

(52) U.S. Cl.
CPC ..... *H01Q 21/30* (2013.01); *H01Q 1/362* (2013.01); *H01Q 5/357* (2015.01); *H01Q 5/378* (2015.01); *H01Q 11/08* (2013.01)

(58) Field of Classification Search
CPC ..... H01Q 11/08
USPC ..... 343/895, 725, 850
See application file for complete search history.

(56) References Cited

U.S. PATENT DOCUMENTS

| | | | |
|---|---|---|---|
| 4,800,395 | A | 1/1989 | Balzano et al. |
| 6,388,625 | B1 | 5/2002 | Fukushima et al. |

(Continued)

FOREIGN PATENT DOCUMENTS

| | | | |
|---|---|---|---|
| CN | 1278959 | A | 1/2001 |
| CN | 1476681 | A | 2/2004 |

(Continued)

OTHER PUBLICATIONS

International Search Report dated Apr. 21, 2011 from corresponding International Application No. PCT/CN2010/075159.

(Continued)

*Primary Examiner* — Dieu H Duong
(74) *Attorney, Agent, or Firm* — Wolf, Greenfield & Sacks, P.C.

(57) ABSTRACT

A dual frequency antenna comprises: a helix coil, of which the lower end is provided with a first resonant coil with a first pitch and of which the upper end is provided with a second resonant coil with a second pitch, for resonating at a frequency lower than the resonant frequency of the first resonant coil, wherein, the first pitch is larger than the second one; a first coupling unit, which is installed in the first resonant coil and is electrically isolated from the first resonant coil, for stabilizing resonant frequency performance of the first resonant coil; and a second coupling unit, which is installed outside the helix coil and is electrically isolated from the helix coil, for increasing equivalent electrical length of the first resonant coil and raising resonant frequency gain of the first coil. By the improvement of the two coupling units in the high frequency part of parts of the resonant structure in the present invention, better resonant frequency performance of the first resonant coil is obtained, thus centralizing performance of the first resonant coil to the upper hemisphere, increasing the distribution current of the first resonant coil, and at the same time increasing the electrical length of the first resonant coil.

10 Claims, 7 Drawing Sheets

(56) References Cited

U.S. PATENT DOCUMENTS

| | | | | |
|---|---|---|---|---|
| 6,501,428 | B1 * | 12/2002 | Blom et al. | 343/702 |
| 2003/0028095 | A1 | 2/2003 | Tulley et al. | |
| 2006/0050009 | A1 | 3/2006 | Ho et al. | |
| 2010/0188303 | A1 * | 7/2010 | Koh et al. | 343/725 |

FOREIGN PATENT DOCUMENTS

| | | | |
|---|---|---|---|
| CN | 1482381 | A | 3/2004 |
| CN | 1630961 | A | 6/2005 |
| CN | 101764281 | A | 6/2010 |
| EP | 1263081 | A2 | 12/2002 |
| JP | H06 37531 | A | 2/1994 |
| WO | WO 99/14819 | A1 | 3/1999 |
| WO | WO 02/25772 | A1 | 3/2002 |

OTHER PUBLICATIONS

Extended European Search Report dated Mar. 4, 2014 from corresponding European Application 10854574.

* cited by examiner

DUAL FREQUENCY ANTENNA

FIELD OF THE INVENTION

The invention relates to an antenna, and more particularly to a dual frequency antenna.

BACKGROUND OF THE INVENTION

At present, a handheld terminal device typically operates at multiple frequency bands, for example, frequency bands required for global system for mobile communication (GSM) and digital cellular system (DCS), an ultra-high frequency (UHF) required for a two-way radio, and a frequency required for global position system (GPS), so as to implement multiple functions or auxiliary functions. An antenna applied to the above handheld terminal device is a dual frequency antenna or a multiple frequency antenna, and most of the dual frequency antennas in the prior art adopt a double branch structure or a partial resonant structure. The dual frequency antenna with the double branch structure is composed of two antennas and the antennas are connected to one feeding point. Each of the two antennas has its resonance not affecting that of the other. Typically, a low frequency resonance is achieved by a helical structure, and a high frequency resonance is achieved by a whip structure. The length of the helical structure is one half of the wavelength (for the frequency of the low frequency resonance), and the length of the whip structure is one quarter of the wavelength (for the frequency of the high frequency resonance). The performance of the antenna operating at the two frequencies is similar to that of a half-wave dipole.

A dual frequency antenna with the partial resonant structure may achieve a dual frequency resonance by changing a pitch of a part of the helical structure, and the length of the part in which the pitch is changed is a resonant length at the other required frequency. The performance of the antenna operating at two frequencies is similar to that of the half-wave dipole. Most of the existing external dual frequency antennas are achieved by the partial resonant structure. In the helical structure, the high frequency resonant part is placed on the bottom of the coil to form a lower frequency resonance together with another part. The particular structure is shown in FIG. 1.

The above-mentioned two kinds of external helical dual frequency antennas are operated at UHF/VHF (Ultra High Frequency) & GPS frequency bands, and the resonance is formed by changing a pitch of a part of the coil or placing a whip antenna at the bottom of the helical, in which the length of the whip antenna is one quarter of the wavelength. This design is relatively simple, and for the GPS frequency band, the performance of the antenna is more centralized on the lower hemisphere. There is a large recess in the upper hemisphere (the part directed to the sky) required by the GPS, and therefore this design has a poor performance and is adverse to the reception of a GPS signal.

Furthermore, if the dual antenna is designed for the VHF frequency band, there is huge difference (approximately 10 frequency multiplication) between the two frequencies, and small deviation of the VHF frequency may cause huge difference of the GPS signal.

SUMMARY OF THE INVENTION

Technical problems to be solved by the present invention are that: in view of the fact that the dual antenna in the prior art has poor performance on the upper hemisphere (the part directed to the sky) and the poor reception of the GPS signal, a dual antenna is provided according to the invention.

According to the invention, the technical solution for solving the technical problems in the present invention includes: constructing a dual antenna which includes a helical coil, where a first resonance coil with a first pitch is provided at the lower part of the helical coil to generate a first resonance frequency, and a second resonance coil with a second pitch is provided at the upper part of the helical coil to generate a resonance frequency lower than the first resonance frequency, the first pitch is larger than the second pitch; and the dual antenna further includes:

a first coupling unit provided inside the first resonance coil and electrically isolated from the first resonance coil, which is configured to stabilize a resonance frequency performance of the first resonance coil; and a second coupling unit provided outside the helical coil and electrically isolated from the helical coil, which is configured to increase an equivalent electrical length of the first resonance coil and a gain of a resonance frequency of the first resonance coil.

The advantages of the invention are as follows. A first coupling unit is added to a high frequency part of the partial resonant structure, so that a better resonance frequency performance of the first resonance coil can be obtained, while the performance of the second resonance coil is not affected. In this way, the resonance frequency performance of the first resonance coil is enabled to be more centralized on the upper hemisphere. With the two added coupling units, the distribution current of the first resonance coil is increased, while the electrical length of the first resonance coil is increased.

BRIEF DESCRIPTION OF THE DRAWINGS

The invention will be further described in conjunction with the drawings and embodiments below, wherein.

DETAILED DESCRIPTION OF THE INVENTION

Figure 1:
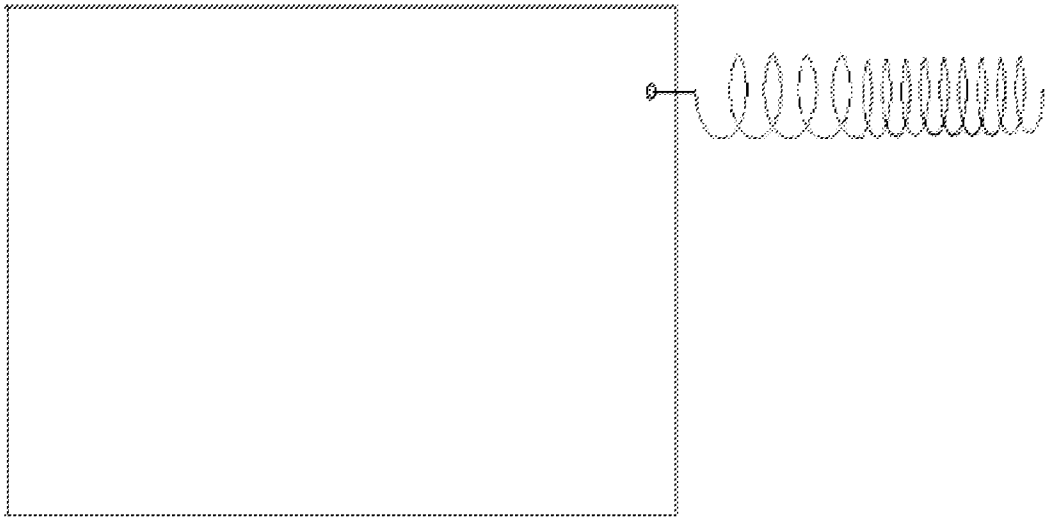
FIG. 1 is a schematic structural diagram of a dual frequency antenna with a partial resonant structure in the prior art, in which a high frequency resonance is implemented at the bottom of a helical coil.
Figure 2:
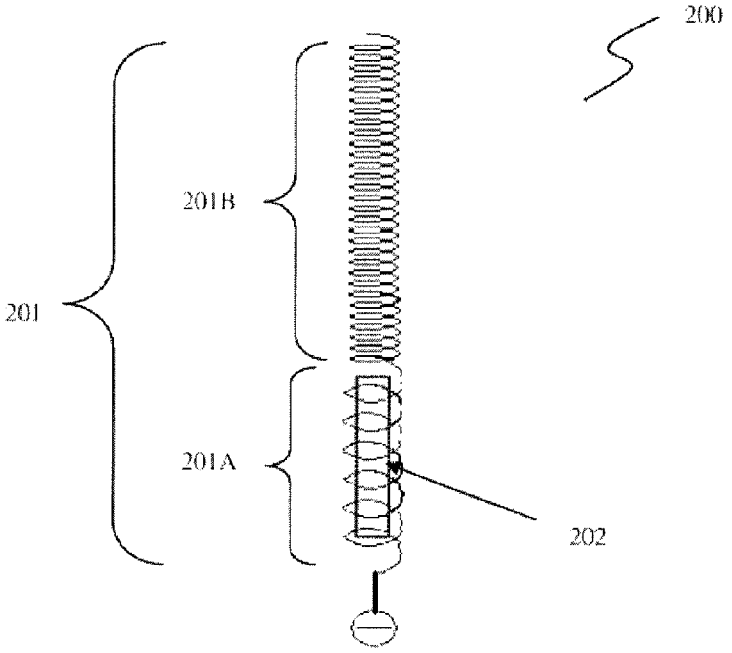
FIG. 2 is a schematic structural diagram of a dual frequency antenna according to an embodiment of the invention.

FIG. 2 is a schematic structural diagram of a dual frequency antenna according to an embodiment of the invention. The dual frequency antenna 200 in FIG. 2 includes a helical coil 201 and a first coupling unit 202. A first resonance coil 201A with a first pitch is provided at the lower part of the helical coil 201. A second resonance coil 201B with a second pitch is provided at the upper part of the helical coil 201, which is configured to generate a lower resonance frequency than the resonance frequency of the first resonance coil, in which the first pitch is larger than the second pitch. The first coupling unit 202 is provided inside the first resonance coil and is electrically isolated from the first resonance coil, which is configured to stabilize resonance frequency performance of the first resonance coil. Therefore, with the added first coupling unit 202, better resonance frequency performance of the first resonance coil can be obtained, while the performance of the second resonance coil is not affected, such that the resonance frequency performance of the first resonance coil is more centralized on the upper hemisphere. A parasitic spurious impedance is an important factor of a stability of a GPS performance, and the parasitic impedance of the first resonance coil 201A can be increased by adding the first coupling unit 202.

Figure 3:
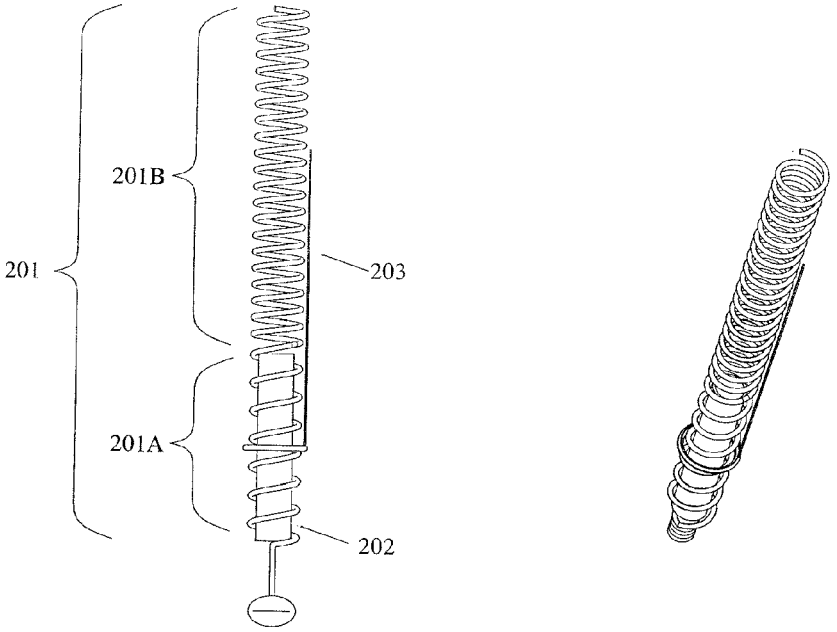
FIG. 3 is a schematic structural diagram of a dual frequency antenna according to another embodiment of the invention.

FIG. 3 is a schematic structural diagram of a dual frequency antenna according to another embodiment of the invention. Compared with the dual frequency antenna in FIG. 2, the dual frequency antenna in FIG. 2 further includes a second coupling unit 203. The second coupling unit 203 is provided outside the helical coil and is electrically isolated from the helical coil, which is configured to increase the equivalent electrical length of the first resonance coil and gain of a resonance frequency of the first resonance coil. The second coupling unit 203 actually increases the height of the second resonance coil. The two coupling units in FIG. 2 and FIG. 3 increase the distribution current of the first resonance coil and the electrical length of the first resonance coil.

The helical coil 201 in FIG. 2 and FIG. 3 is a complete coil, and the upper part and the lower part thereof have different pitches. For convenience of description, the upper part with the first pitch is referred to as the first resonance coil 201A, and the lower part with the second pitch is referred to as the second resonance coil 201B. Typically, the dual frequency antennas in FIG. 2 and FIG. 3 operate in the GPS and VHF frequency bands, in which the first resonance coil 201A operates in the GPS frequency band and the second resonance coil 201B operates in the VHF frequency band. The relation between the sizes of the first pitch and the second pitch is determined by a variable pitch helical coil 201, as long as the dual frequency reception can be achieved by the variable-pitch helical coil 201. In general, the size of the first pitch is more than twice as much as that of the second pitch to ensure the base performance in the GPS frequency band.

In an embodiment of the invention, the length of the first resonance coil 201A is about one half of the wavelength of the operation frequency band (GPS frequency band) of the first resonance coil 201A, and the length of the second resonance coil 201B is about one half of the wavelength of the operation frequency band (VHF frequency band) of the second resonance coil 201B.

FIG. 2 is a planar schematic diagram of the dual frequency antenna 200. As shown in FIG. 2, the first coupling unit 202 has a rectangle shape. Actually, the first coupling unit 202 has a cross-section of a rectangle shape, and the first coupling unit 202 is a cylinder made of metallic material, the radius of which is close to (slightly less than) the inner radius of the helical coil. The height of the first coupling unit 202 is about one eighth of the wavelength of the operation frequency band of the first resonance coil. In FIG. 3, the second coupling unit 203 is a metal wire, and the length thereof is less than one half of the wavelength (9.5 mm) of the operation frequency band (GPS frequency band) of the first resonance coil.

In an embodiment of the invention, the first coupling unit 202 is an inverted truncated cone made of metallic material. The bottom of the first coupling unit 202 is upward and close to the second resonance coil 201B, and the radius of the bottom is approximate to the inner radius of the helical coil. This embodiment may be taken as one preferable embodiment to implement the invention. In another embodiment of the invention, the first coupling unit 202 is a cone made of metallic material.

In an embodiment of the invention, the second coupling unit 203 is a metal wire. One end of the second coupling unit 203 is a circle surrounding the first resonance coil 201A 3, for example, a circle with an open (i.e., the circle is non-closed), so as to fix the second coupling unit 20. The circle end of the second coupling unit 203 is provided outside the first resonance coil 201A, and the other end extends to a certain part of the second resonance coil 201B.

The circle with an open may be provided nearby the ends of the first resonance coil 201A. In this case, a coupling of a voltage can be achieved to maximize the voltage. The length of the second coupling unit 203 is less than or equal to one half of the wavelength of the GPS frequency band.

In yet another embodiment of the invention, one end of the second coupling unit 203 is a closed circle which is provided at the middle of the first resonance coil and surrounds the first resonance coil. In this case, maximum current coupling can be achieved.

In FIG. 2 and FIG. 3, the first coupling unit 202 and the second coupling unit 203 are electrically isolated from the helical coil. That is to say, the first coupling unit 202 and the second coupling unit 203 have no electrical contact with the helical coil.

The dual frequency antenna 200 has the performance of the GPS more centralized on the upper hemisphere. The performance of the GPS resonance coil is stabilized by adopting the first coupling unit 202. The equivalent electrical length of the GPS and the gain of the resonance frequency of the GPS can be increased by the second coupling unit 203.

The dual frequency antenna 200 according to the invention is applicable to a professional interphone or other electronic device. The dual frequency antenna 200 is connected to the electronic device via the feeding point of the electronic device, so as to transmit the received signal to the electronic device.

For explaining more clearly the performance of the dual frequency antenna according to the invention, a simulation result of the dual frequency antenna 200 will be introduced below.

Figure 4:
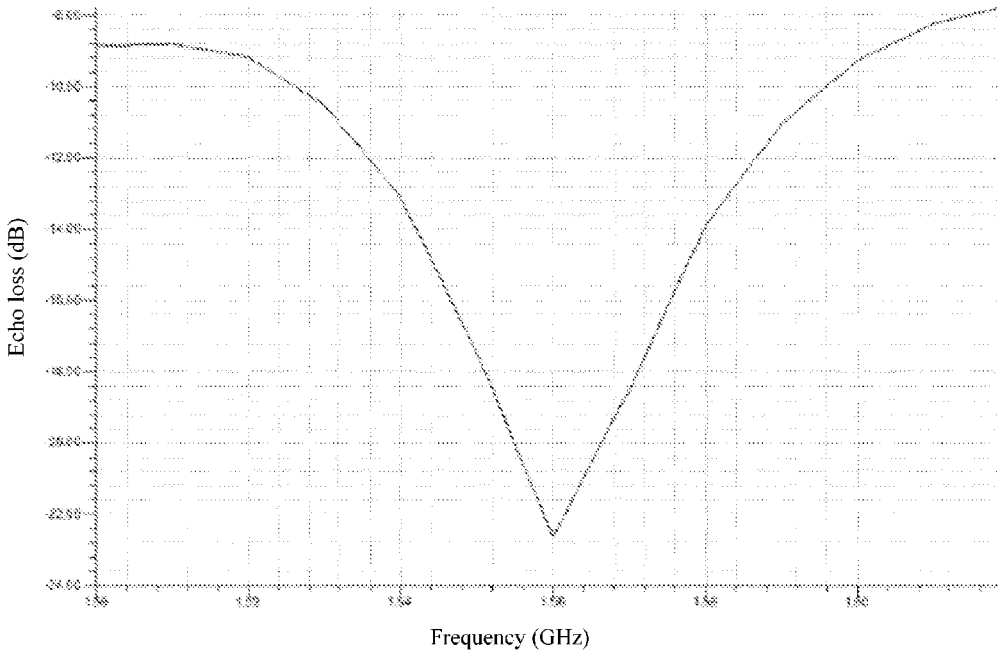
FIG. 4 is a schematic diagram of a GPS frequency band specification of the dual frequency antenna in FIG. 3.
Figure 5:
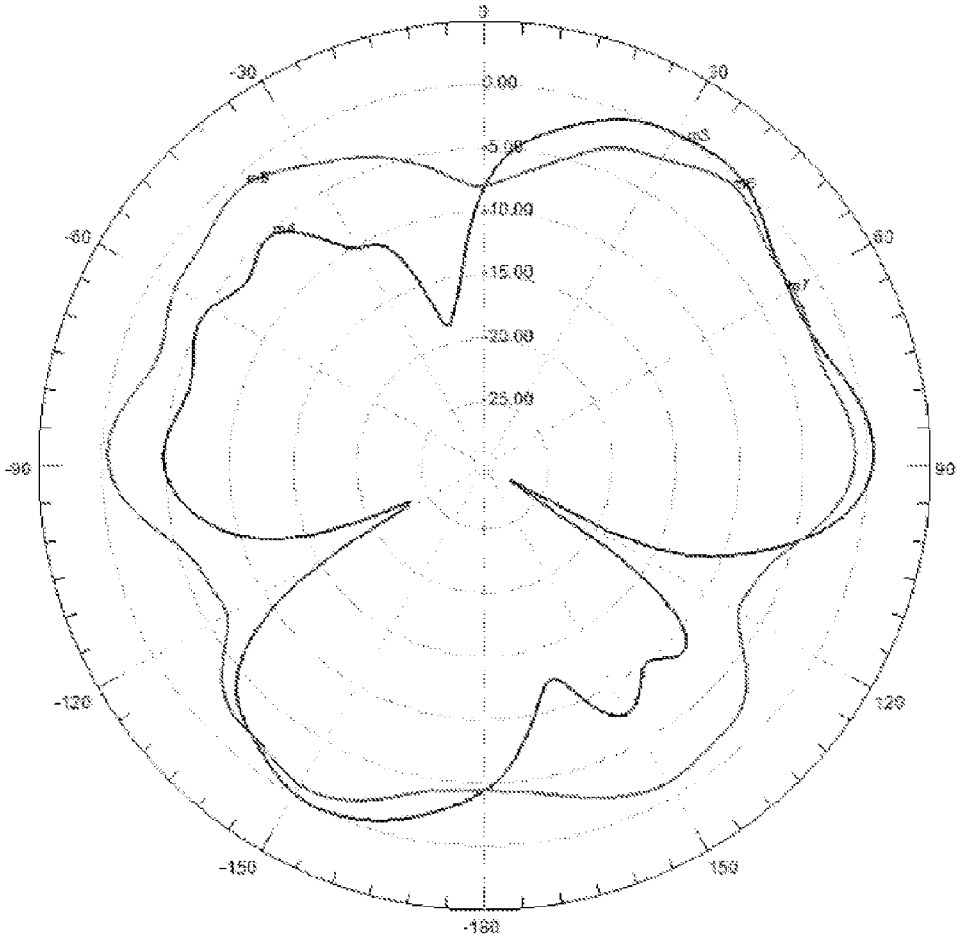
FIG. 5 is a simulated gain pattern in GPS frequency band of the dual frequency antenna in FIG. 3.

FIG. 4 is a schematic diagram of a GPS frequency band specification of the dual frequency antenna in FIG. 3, and FIG. 5 is a simulated gain pattern in GPS frequency band of the dual frequency antenna in FIG. 3. As shown in FIGS. 4 and 5, the performance in the GPS frequency band is relatively good, one half of the performance of the antenna is centralized on the upper hemisphere, the gain of the antenna is about 0 dBi, and the antenna has a larger peak gain angle (PGA) (it is to be noted that the data of the gain in this simulation is an ideal value in the case that a cover of the antenna and a housing of a radio are not provided, and a PCB loss is not considered). In FIG. 5, the m3, m4, m5 and m6 indicate the positions of the PGA, and the m7 indicates the position of the minimum value of the gain for two lobes.

Figure 6:
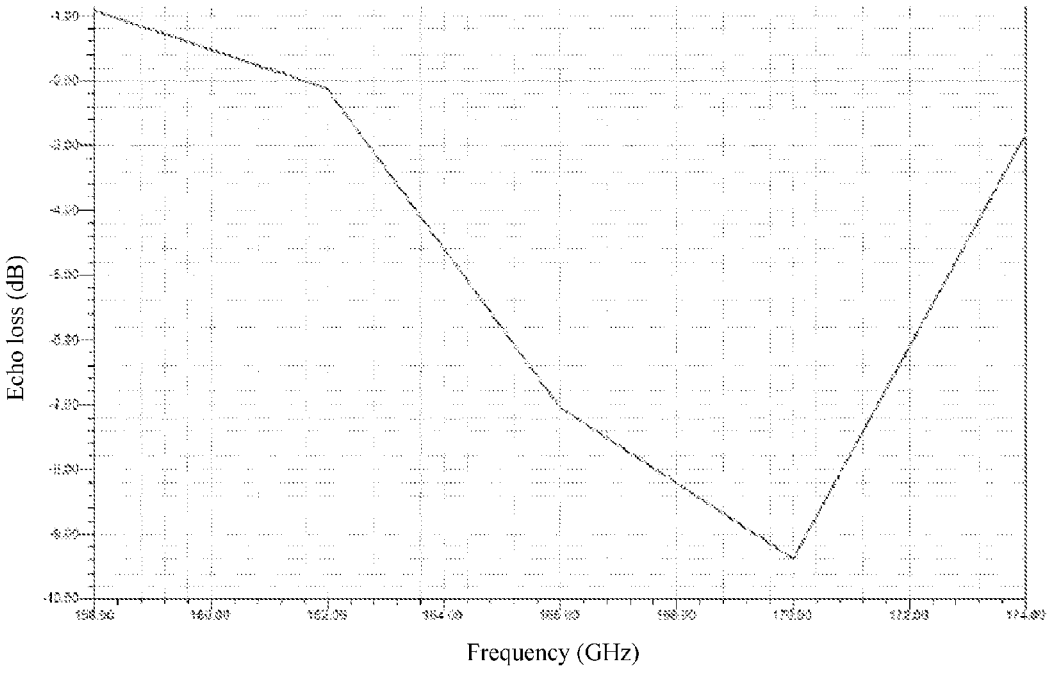
FIG. 6 is a schematic diagram of a VHF frequency band specification of the dual frequency antenna in FIG. 3.
Figure 7:
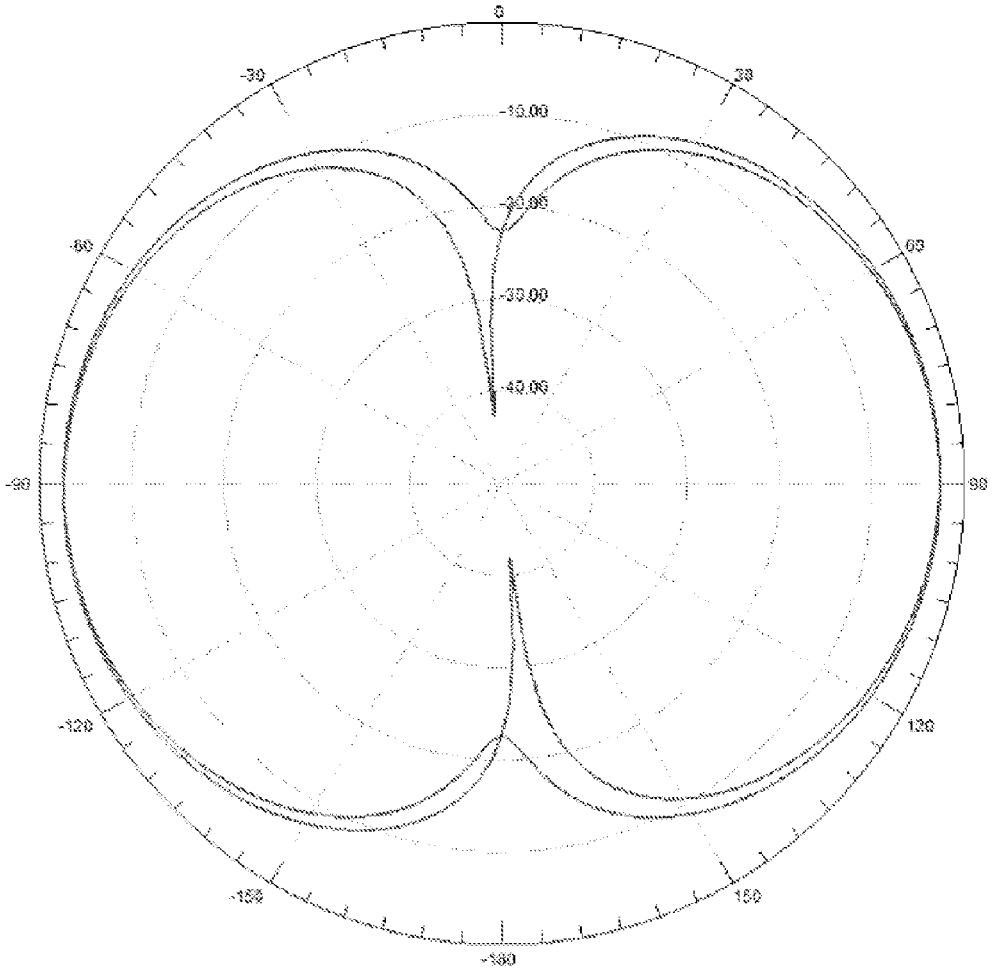
FIG. 7 is a simulated gain pattern in VHF frequency band of the dual frequency antenna in FIG. 3.

FIG. 6 is a schematic diagram of a VHF frequency band specification of the dual frequency antenna in FIG. 3, and FIG. 7 is a simulated gain pattern in VHF frequency band of the dual frequency antenna in FIG. 3. As shown in FIGS. 6 and 7, the dual frequency antenna according to the invention can improve the performance of the GPS while the performance of the VHF will not be affected.

Figure 8:
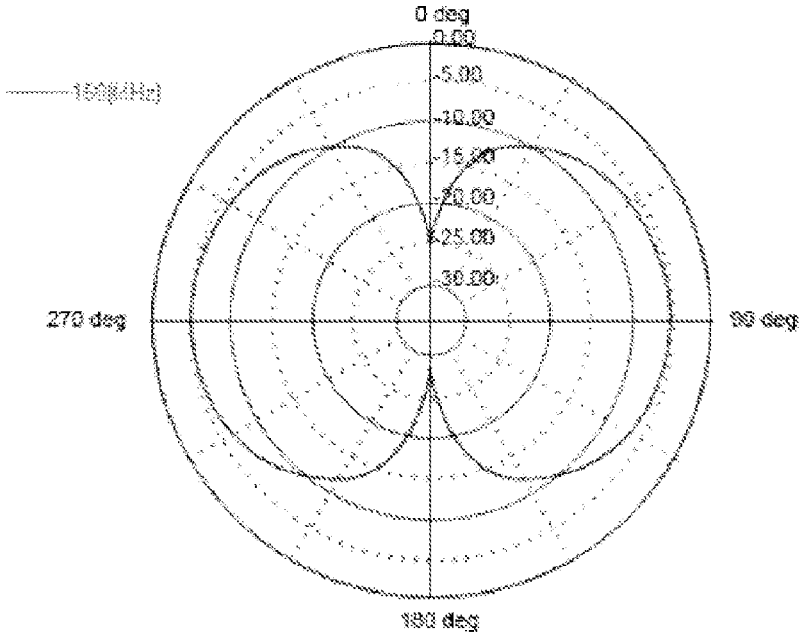
FIG. 8 is a measurement radiation pattern of a sample of the dual frequency antenna in FIG. 3, in the VHF frequency band.

To verify the performance of the dual frequency antenna according to the invention, a network analyzer and a microwave dark room are used to test a sample of the dual frequency antenna. FIG. 8 is a measurement radiation pattern of the dual frequency antenna of FIG. 3 in the VHF frequency band, and FIG. 9 is a measurement radiation pattern of the dual frequency antenna of FIG. 3 in the GPS frequency band.

Figure 9:
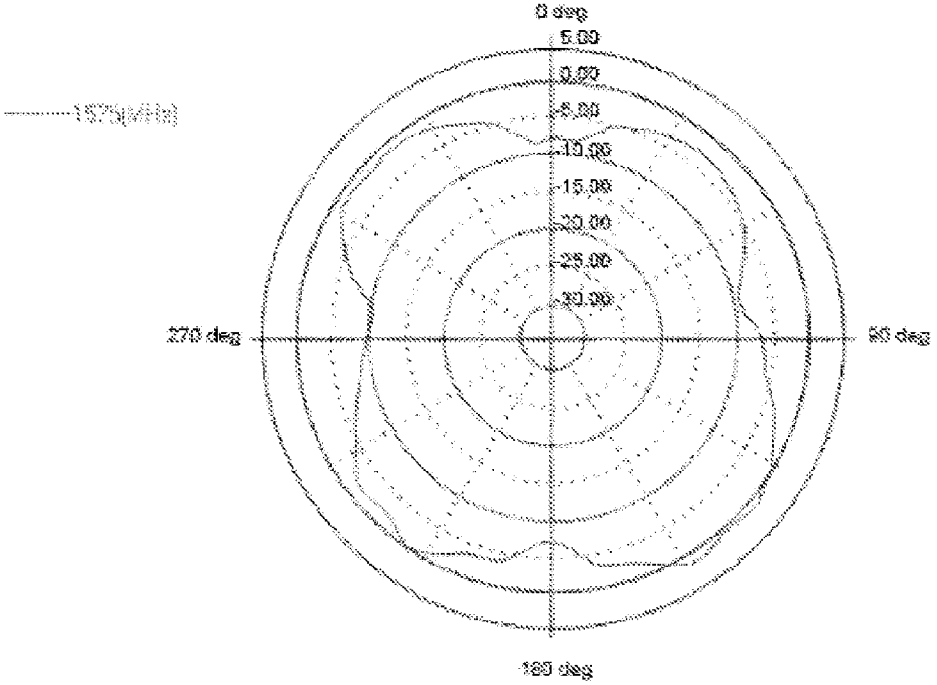
FIG. 9 is a measurement radiation pattern of a sample of the dual frequency antenna in FIG. 3, in the GPS frequency band.

As shown in FIGS. 8 and 9, the gain of the antenna is good. The gain in the VHF frequency band (160 MHz in the figures) is about −5 dBi, and the gain in the GPS frequency band (1575 MHz in the figures) is about 0 dBi. The radiation pattern are approximately symmetrical, and the measured gain of the GPS is substantially coincident with that in the simulation. Therefore, with the dual frequency antenna according to the invention, a better performance of the GPS can be obtained while the performance of the VHF will not be affected. When the antenna is applied to a professional interphone, a good reception effect can be obtained for the GPS.

The embodiments described above are only preferred embodiments of the invention, and the invention is not limited to the specific embodiments. All the modifications, equivalent substitutions and improvements made within the spirit and scope of the invention fall within the scope of protection of the invention.

The invention claimed is:

1. A dual frequency antenna, comprising a helical coil wherein a first resonance coil with a first pitch is provided at the lower part of the helical coil, and a second resonance coil with a second pitch is provided at the upper part of the helical coil to generate a resonance frequency lower than a resonance frequency of the first resonance coil, and the first pitch is larger than the second pitch; and wherein the dual frequency antenna further comprises:

a first coupling unit provided inside the first resonance coil and electrically isolated from the first resonance coil, which is configured to stabilize a resonance frequency performance of the first resonance coil;

wherein only the first resonance coil of the helical coil operates at a GPS frequency band.

2. The dual frequency antenna according to claim 1, further comprising a second coupling unit provided outside the helical coil and electrically isolated from the helical coil, which is configured to increase an equivalent electrical length of the first resonance coil and a gain of a resonance frequency of the first resonance coil.

3. The dual frequency antenna according to claim 2, wherein a diameter of the first coupling unit is slightly smaller than an inner diameter of the first resonance coil.

4. The dual frequency antenna according to claim 2, wherein the second resonance coil of the helical coil operates at a VHF frequency band.

5. The dual frequency antenna according to claim 1, wherein the length of the first resonance coil is one half of a wavelength of an operation frequency band of the first resonance coil, and the length of the second resonance coil is one half of a wavelength of an operation frequency band of the second resonance coil.

6. The dual frequency antenna according to claim 1, wherein the first coupling unit is a cylinder or inverted truncated cone which is made of metallic material.

7. The dual frequency antenna according to claim 6, wherein the height of the first coupling unit is one eighth of a wavelength of an operation frequency band of the first resonance coil.

8. The dual frequency antenna according to claim 2, wherein the second coupling unit is a metal wire, and a length of the second coupling unit is less than or equal to one half of a wavelength of an operation frequency band of the first resonance coil.

9. The dual frequency antenna according to claim 8, wherein one end of the second coupling unit is a circle which surrounds the first resonance coil and fixes the second coupling unit.

10. The dual frequency antenna according to claim 8, wherein one end of the second coupling unit is a closed circle which is provided at the middle of the first resonance coil and surrounds the first resonance coil.

* * * * *